US005669036A

United States Patent [19]

Hotta et al.

[11] Patent Number: 5,669,036

[45] Date of Patent: Sep. 16, 1997

[54] IMAGE FORMING METHOD

[75] Inventors: Yozo Hotta; Masahiro Goto; Toshio Miyamoto, all of Yokohama, Japan

[73] Assignee: Canon Kabushiki Kaisha, Tokyo, Japan

[21] Appl. No.: 590,333

[22] Filed: Jan. 23, 1996

[30] Foreign Application Priority Data

Jan. 25, 1995 [JP] Japan ..... 7-009779
Apr. 26, 1995 [JP] Japan ..... 7-102379

[51] Int. Cl.[6] ..... G03G 21/00

[52] U.S. Cl. ..... 399/53; 399/58

[58] Field of Search ..... 355/208, 246, 355/245, 203, 214; 430/105, 107, 111, 120

[56] References Cited

U.S. PATENT DOCUMENTS 5,010,370 4/1991 Araya et al. ..... 355/274
5,212,522 5/1993 Knapp ..... 355/208
5,456,990 10/1995 Takagi et al. ..... 430/111 X
5,474,869 12/1995 Tomita et al. ..... 430/111 X
5,519,471 5/1996 Nishimura et al. ..... 355/246
5,534,982 7/1996 Sakaizawa et al. ..... 355/246

*Primary Examiner*—Matthew S. Smith
*Attorney, Agent, or Firm*—Fitzpatrick, Cella, Harper & Scinto

[57] ABSTRACT

An image forming method is disclosed in which an optical image is formed on an electrostatic latent image bearing member, and its light intensity is modulated in accordance with image information to form an electrostatic latent image, and then development is performed. At the time of formation of an electrostatic latent image formed of the smallest isolated dots on the electrostatic latent image bearing member, the charge density distribution, weight average particle diameter of a toner, and Q/M distribution of the toner satisfy the relationship of:

$$f > \frac{a}{x^A y^B}.$$

8 Claims, 3 Drawing Sheets

8×8 DITHER MATRIX

GRAPH OF LATENT IMAGE POTENTIAL DIFFERENCE x AND NUMBER PERCENTAGE f OF TONER WITH Q/M-5(μC/g) OR MORE

GRAPH OF TONER WEIGHT AVERAGE PARTICLE DIAMETER y AND NUMBER PERCENTAGE f OF TONER WITH Q/M-5(μC/g) OR MORE

IMAGE FORMING METHOD

BACKGROUND OF THE INVENTION

1. Field of the Invention

This invention relates to an image forming method, and more particularly to an image forming method of an electrophotographic system that is connected to a host computer such as personal computers, office computers, minicomputers or the like and prints images in accordance with image information and instructions sent from the host computer.

2. Related Background Art

In conventional image forming methods that employ electrophotographic systems such as digital copying machines and laser beam printers, commands relating to print and encoded character and design information are received as data from an external information processor, such as a computer or a work station, and the encoded information is converted into pixel information in a formatter. When converted, image data having density information such as in photographs are subjected to image processing such as dither matrixing and made into a binary form.

Next, this image information is printed at the part of an electrophotographic engine. An electrophotographic cartridge is comprised of an electrophotographic photosensitive member, a charging roller, a developing assembly and a cleaner as one unit. The electrophotographic photosensitive member comprises a cylindrical substrate made of aluminum or nickel and a photosensitive material such as OPC, amorphous Se or amorphous Si formed on the substrate, and is called a photosensitive drum. The surface of the photosensitive drum is uniformly electrostatically charged by the charging roller. Next, image signals are raster-scanned by a laser scanner. In the laser scanner, with the on-off of a semiconductor laser, image signals are scanned with a polygonal scanner to form optical spot images on the photosensitive drum by means of an optical system and a return mirror. Thus, an electrostatic latent image is formed. The electrostatic latent image formed is developed by the developing assembly. To carry out the development, jumping development, two-component development or feed development is used, where image exposure is carried out by turning on a laser at the recording area to make the latent image have no electric charges and is often used in combination with the reverse development carried out by causing toner to adhere to areas having less electric charges.

The image formed by development (a toner image) is transferred to transfer mediums. The transfer mediums are held in a cassette, and are fed sheet by sheet by means of a paper pick-up roller. Once print signals are sent from the host apparatus, a transfer medium is fed through the paper pick-up roller, and a transfer roller is operated while being synchronized with the image signals by a timing roller, so that the toner image is transferred to the transfer medium. The transfer roller is an elastic member having conductivity and a low hardness, where the toner image is electrostatically transferred by the aid of a bias electric field at a nip formed between the photosensitive drum and the transfer roller.

The transfer medium on which the image has been transferred is sent to a fixing assembly to fix the image, which is then delivered by a paper output roller and put out to a paper output tray. Meanwhile, to remove the toner remaining after transfer, the photosensitive drum surface is cleaned by a blade of a cleaner assembly.

The light-emission intensity and light-emission duty of the semiconductor laser of the laser scanner is controlled by an exposure control section.

Bias voltages applied to the charging roller, bias voltages applied to the developing assembly and bias voltages applied to the transfer roller are controlled by a high-voltage control section.

Main motors and scanner motors are controlled by a motor control section.

Pressure and temperature of the fixing assembly are controlled by a fixing control section.

The operation of the paper pick-up roller and timing roller is controlled by a paper feed control section.

In the conventional image forming method as described above, users have not so much been required to use graphic images as outputs from printers of an electrophotographic system, and where it is unnecessary to develop every dot with regard to character images and there has not been a problem. Recently, however, users often print out graphic images by the use of the electrophotographic printers, and it has become necessary to develop every dot. This is because, even though high resolution has been achieved as a result of an advance in scanner drivers, details may disappear at highlights and the valuable high resolution can not be well provided unless every dot is developed. Since, however, the on-state time of lasers becomes shorter and the laser spot diameter becomes larger with respect to the image size as the electrophotographic printers have a higher resolution, digital latent images can not be formed and the potential difference of a latent image (i.e., difference between dark portion potential Vd and light portion potential Vl of a latent image) becomes smaller, causing the problem that every dot can be developed only with difficulty. For example, when an image is printed using an electrophotographic printer having a resolution of 1,200 dpi (pixel size: about 21 μm), and a semiconductor laser which emits light in such an intensity that the charge potential, (i.e., dark portion potential Vd) of an electrophotographic photosensitive member is −650 V and the light portion potential Vl of the electrophotographic photosensitive member is −150 V is used, the laser spot diameter of the semiconductor and the potential difference, |Vd−Vl| (V), of a one-dot latent image have the relationship as shown in Table 1 below.

TABLE 1

Relationship between Laser Spot Diameter and Potential Difference of One-dot Latent Image

| Laser spot diameter (μ) | One-dot latent image \|Vd − Vl\| (V) |
|---|---|
| 83 pm | 63 |
| 62 pm | 112 |
| 41 pm | 224 |
| 20 pm | 481 |

That is, ideally, it is preferable for the laser spot diameter to have a size substantially equal to the size of one pixel. In practice, however, from the viewpoint of cost of optical systems, it is common for the laser spot diameter to have a size of about 80 μm. The size of one pixel is about 84 μm at 300 dpi, and about 42 μm at 600 dpi, and hence, at 300 dpi, there is no problem when the laser spot diameter has a size substantially equal to the size of one pixel. At 600 dpi, however, the latent image is formed in a laser spot diameter having a size about twice that of one pixel. Nevertheless, although every dot can be developed if only the light intensity is controlled so long as the laser spot diameter can be within the size about twice that of one pixel, it becomes impossible to form the latent image digitally for every dot when, for example, the resolution is as high as 800 dpi or more, because the laser spot diameter has a size nearly three times the size of one pixel. Accordingly, in the electrophotographic printers, to perform the development of every dot necessary for obtaining graphic images with a high resolution, measures are taken such that the light intensity is made higher, the DC component of development bias is made stronger, or the dark portion potential Vd of a latent image is made higher.

In the above conventional case, it is true that every dot can be developed at a high resolution in the electrophotographic printers when measures are taken such that the light intensity is made higher, the DC component of development bias is made stronger, the frequency of development bias is made smaller, or the dark portion potential Vd of a lagent image is made higher, but another problem arises such that the images may block up at high-density areas of a gray scale. Such block-up of images at the high-density areas of a gray scale makes gradation poor at high-density areas of the graphic images, resulting in images not well provided with a high resolution and having a dark impression. It also brings about an increase in toner consumption to cause such a difficulty that fog may seriously occur correspondingly with an increase in the toner consumption. It still also results in an increase in the toner remaining on the drum after transfer, tending to cause the problem of faulty cleaning, and consequently the graphic images can not be improved even when formed at a high resolution.

Hence, basically the laser spot diameter must be reduced to the pixel size or so, but, if it is too much reduced, the focal length becomes not more than 1 mm, so that the scanner must be precisely fitted to the main body and the function of automatic focussing must be provided, resulting in a high cost.

SUMMARY OF THE INVENTION

An object of the present invention is to provide an image forming method that can solve the problem that every dot can not be developed and high-density areas of a gray scale may block up to make it impossible to form graphic images when the spot diameter of light at a high resolution is not so much reduced.

The present invention provides an image forming method comprising forming an optical image on an electrostatic latent image bearing member, and modulating its light intensity in accordance with image information to form an electrostatic latent image, followed by development, wherein;

at the time of formation of an electrostatic latent image formed of the smallest isolated dots on the electrostatic latent image bearing member, the charge density distribution, weight average particle diameter of a toner, and Q/M distribution of the toner satisfy the relationship of:

$$f > \frac{a}{x^A y^B}$$

wherein f is a number percentage (expressed in decimal form where 1 represents 100%) of a toner having Q/M of |5| (μC/g) or more based on the whole toner, where Q/M is a charge quantity Q per unit weight M; x is a potential difference |Vd−Vl| (V) of the latent image formed of the smallest isolated dots, where Vd is a dark portion potential of the latent image and Vl a light portion potential; y is a weight average particle diameter (m) of the toner; a is a positive constant, where $a=2.89\times10^{-12}$; and A and B are multipliers of x and y, respectively, where A=0.4 and B=2.2.

The present invention also provides an image forming method comprising forming an optical image on an electrostatic latent image bearing member, and modulating its light intensity in accordance with image information to form an electrostatic latent image, followed by development while changing a development bias AC component, wherein;

at the time of formation of an electrostatic latent image formed of the smallest isolated dots on the electrostatic latent image bearing member, the charge density distribution, weight average particle diameter of a toner, Q/M distribution of the toner, and development bias AC component satisfy the relationship of:

$$f > \frac{b}{x^A y^B}$$

$$\left( b = \frac{a}{\frac{E}{E_0}} \quad E_0 = \frac{|V_{dc0}| + \frac{\alpha_0}{2} + |V_{d0} - x|}{d_0} \quad E = \frac{|V_{dc}| + \frac{\alpha}{2} + |V_d - x|}{d} \right)$$

wherein f is a number percentage (expressed in decimal form where 1 represents 100%) of a toner having Q/M of |5| (μC/g) or more based on the whole toner, where Q/M is a charge quantity Q per unit weight M; x is a potential difference |Vd−Vl| (V) of the latent image formed of the smallest isolated dots, where Vd is a dark portion potential of the latent image and Vl a light portion potential; y is a weight average particle diameter (m) of the toner; a is a positive constant, where $a=2.89\times10^{-12}$; A and B are multipliers of x and y, respectively, where A=0.4 and B=2.2; E and $E_0$ are each an electric field applied across the electrostatic latent image bearing member and a toner carrying member; $V_{dc}$ is a development bias DC component and $V_{dc0}$ is |500| (V); α is the development bias AC component and $\alpha_0$ is 1,600 (V); Vd is a dark portion potential on the electrostatic latent image bearing member and $V_{d0}$ is |650| (V); and d is a distance between the electrostatic latent image bearing member and the toner carrying member and $d_0$ is 300 (μm).

The present invention makes it possible to provide an image forming method by which not only can every dot be developed without so much reducing the laser spot diameter of the scanner of an electrophotographic printer having a high resolution, but also the toner consumption can be decreased, and hence the problem of faulty cleaning may hardly occur, fog may also occur less, and high-density areas of a gray scale can be prevented from blocking up, making it possible to form graphic images having an optimum high resolution.

DESCRIPTION OF THE PREFERRED EMBODIMENTS

In the following embodiments, the present invention will be described by giving an example in which a negative electrostatic image is reverse-developed using a negatively charged toner. Needless to say, also when a positive electrostatic image is reverse-developed using a positively charged toner, the relationship of:

$$f > \frac{a}{x^A y^B} \text{ or } f > \frac{b}{x^A y^B}$$

may be satisfied, whereby an image forming method promising a good reproducibility of graphic images can be provided.

First Embodiment

Figure 1:
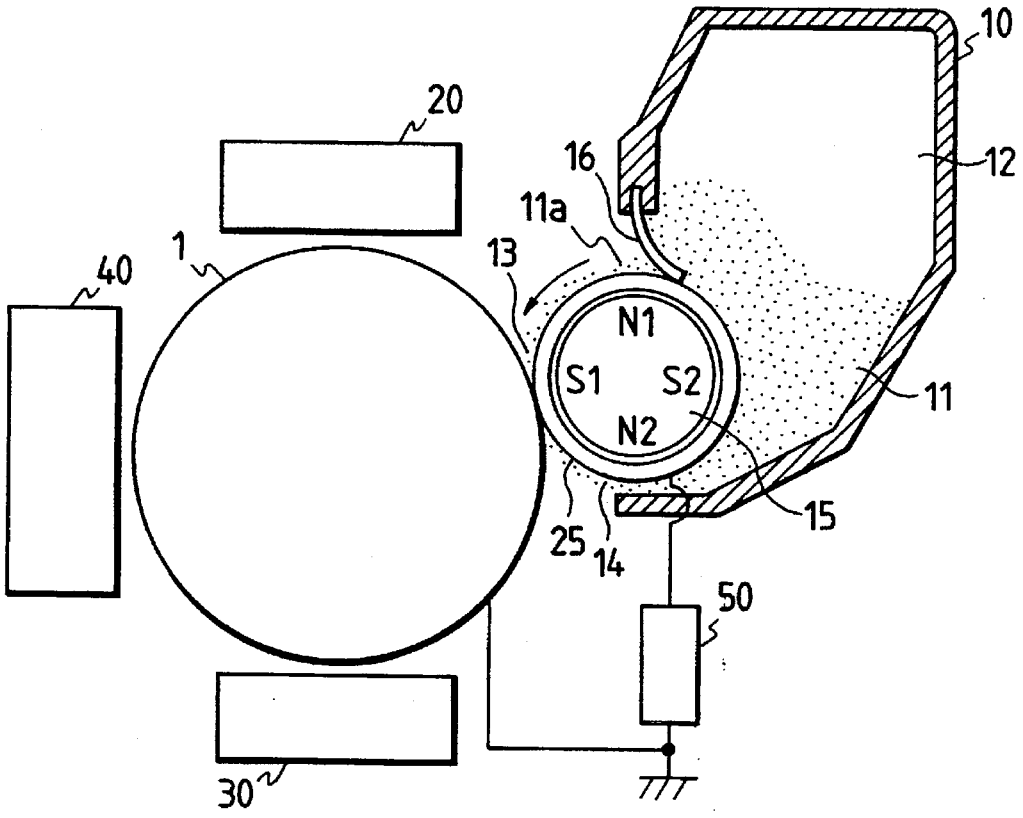
FIG. 1 illustrates an image forming apparatus used in a first embodiment of the present invention.

FIG. 1 shows an example of an image forming apparatus employing the image forming method according to the present invention.

On an electrophotographic photosensitive member or an electrostatic recording dielectric member, which is the electrostatic latent image bearing member, beforehand uniformly electrostatically charged, an electrostatic latent image is formed by an exposure means such as an optical means by which the surface of the member is scanned with, for example, a semiconductor laser beam modulated by pixel information. As a developing method for developing this electrostatic latent image, a method is known in which the electrostatic latent image is developed by, for example, causing a developer to move from a developer carrying member so as to be imparted to the electrostatic latent image held on the electrostatic latent image bearing member, at its part forming a given minute gap in the developing zone facing the electrostatic latent image bearing member. The image thus developed (a toner image) is transferred to a transfer medium through a transfer means. The transfer medium to which the toner image has been transferred is separated from the electrostatic latent image bearing member and sent to a fixing means such as a heat-fixing assembly (not shown), where the toner image is fixed to the transfer medium. The transfer medium having passed through the fixing means is outputted to the outside of the image forming apparatus.

As shown in FIG. 1, a developing assembly 10 has a developing sleeve 14 that is rotatable in the direction of an arrow, serving as the developer carrying member, which is provided opposingly to a drum type electrophotographic photosensitive member, i.e., a photosensitive drum 1. On this photosensitive drum, the electrostatic latent image is formed by a known electrostatic latent image forming means 20 having a charger, an exposure means and so forth. As the exposure means, a means for projecting an optical image of an original or an optical system by which the drum surface is scanned with a laser beam modulated by recording image signals is employed. Thus, the latent image formed on the photosensitive drum 1 is formed into the toner image by means of the developing assembly 10.

The toner image thus obtained is transferred to a transfer medium such as paper through a known transfer means 30 having a transfer charger and so forth. The transfer medium to which the toner image has been transferred is separated from the photosensitive drum 1 and sent to a known fixing means (not shown), where the toner image is fixed to the transfer medium.

The toner remaining on the photosensitive drum 1 from which the toner image has been transferred is removed by a known cleaning means 40 making use of a cleaning blade. The cleaning blade has a hardness of about 65° (JIS A), is secured to a blade holder made of a steel sheet, and is brought into touch with the surface of the photosensitive drum 1 at a deformation of from 0.5 to 1 mm to carry out cleaning.

The developing assembly 10 has a developer container 12, and an insulating one-component magnetic developer 11 containing no carrier particles is held therein. This developer 11 is mainly composed of an insulating magnetic toner, and, preferably, fine silica powder is externally added in a little quantity. The fine silica powder is externally added for the purpose of controlling triboelectric charges of the toner so that the image density can be increased and also images with less coarseness can be obtained. It is known to externally add, for example, silica produced by a gaseous phase process (dry process silica) and/or silica produced by a wet process (wet process silica) to the toner.

The one-component magnetic developer, i.e., a magnetic toner 11 is carried on a non-magnetic developing sleeve 14 made of aluminum, stainless steel or the like, which serves as the developer carrying member, rotating in the direction of an arrow, and is carried out of the container 12 and transported to the developing zone, 13, facing the photosensitive drum 1. In the developing zone 13, the photosensitive drum 1 and the developing sleeve 14 face each other with a minute gap of 300 μm. In this developing zone 13, the toner 11 is caused to move from the developing sleeve so as to be imparted to the electrostatic latent image held on the photosensitive drum 1, where the electrostatic latent image is developed as the toner image.

A layer thickness control member for the toner transported to the developing zone 13 will be described here. The thickness of a developer layer 11*a* on the developing sleeve 14 is controlled by an elastic blade 16. This elastic blade is formed of an elastic material such as urethane rubber, has a thickness of from 1 to 1.5 mm and a free length of about 10 mm, is secured to a holder made of a steel sheet, and is brought into touch with the surface of the sleeve 14 at a pressure of about 30 g/cm at its position substantially facing a magnetic pole N1 of a magnet 15. By this blade 16, a thin developer layer 11*a* is formed on the developing sleeve 14.

Such a toner coating method has the advantage that the thickness of the coating layer is mainly governed by the shape of magnetic fields or electric fields and is not so affected by unstable factors such as triboelectricity and an agglomerating force of the toner. Also, since the coated toner is attracted to the surface of the developing sleeve by a magnetic force, the toner may less scatter.

In the image forming apparatus shown in FIG. 1, non-contact development is carried out in the manner as described above. More specifically, the thickness of the toner layer 11*a* moved to the developing zone 13 is smaller than the minute gap between the developing sleeve 14 and the photosensitive drum 1, and hence the toner 11 flies from the developing sleeve 14 through the air gap to reach the photosensitive drum 1. Then, in order to improve development efficiency at this step and to form developed images having a high density, being sharp and having been prevented from fogging, a development bias voltage containing an AC component is applied to the developing sleeve 14 from a bias power source 50.

In the present embodiment, when a latent image having a dark portion potential of −650 V and a light portion potential of −100 V is reverse-developed using the negatively charged toner, a rectangular wave voltage having a DC component of −500 V and, an AC component, having a peak-to-peak voltage with a frequency of 1.8 kHz, was used as the development bias voltage.

The above bias voltage causes the toner 11 to be mutually acted by an electric field directing the toner to move from the developing sleeve 14 to the photosensitive drum 1 and an electric field directing the toner to inversely move from the photosensitive drum 1 to the developing sleeve 14, so that a good developed image can be obtained.

The above toner 11 is electrostatically charged to the polarity at which the electrostatic latent image is developed, chiefly as a result of the friction between toner particles and the developing sleeve 14. As the toner 11 used, it may be basically an insulating magnetic toner comprising, for example, a binder resin mainly composed of a styrene-acrylic copolymer, incorporated with 60% by weight of magnetite and 1% by weight of a metal complex salt of a monoazo dye as a negative charge control agent, and having a volume resistivity of about $10^{13}$ Ω·cm, and to which fine silica particles having been made hydrophobic has been externally added in order to improve the fluidity in an amount of 0.4% by weight based on the weight of the toner. This toner is charged to the negative polarity as a result of its friction with the developing sleeve 14.

In the above image forming apparatus, in order to develop every dot when a latent image formed on the electrostatic latent image bearing member at a high resolution has no deep valleys, the Q/M of the toner is increased. However, if the Q/M of the toner is −20 (μC/g) or above or −30 (μC/g) or above, problems on images may arise such that solid black images have an insufficient density due to charge-up during running in an environment of low temperature and low humidity, or fog occurs. Now, as a result of extensive studies, it has been found that the number percentage of a toner having Q/M of −5 (μC/g) or more, i.e., having a negative triboelectricity not lower than −5 (μC/g), based on the whole toner is effective in order to prevent such problems on images and also develop the smallest isolated dots, i.e., every dot. Thus, in the present embodiment, in order to develop every dot at a high resolution to obtain an optimum image, the image forming method is characterized by satisfying the conditions of expression (1):

$$f > \frac{a}{x^A y^B} \quad (1)$$

In the expression (1), letter symbol f is a number percentage (expressed in decimal form where 1 represents 100%) of the toner having Q/M of −5 (μC/g) or more based on the whole toner, x is a potential difference |Vd−Vl| (V) of the latent image, and y is a weight average particle diameter (m) of the toner. Letter symbol a is a positive constant, where $a=2.89\times10^{-12}$, and A and B are multipliers of x and y, respectively, where A=0.4 and B=2.2. With regard to x, the potential difference of the latent image, the higher the resolution is, the less the latent image with deep valleys can be formed and the smaller the value of x becomes. Thus, the foregoing indicates that the number percentage of the toner having Q/M of −5 (μC/g) or more based on the whole toner must be made greater in order to develop every dot at a high resolution. With regard to y, the weight average particle diameter (m) of the toner, the smaller the toner particle diameter is, the higher the Q/M necessary for the toner to fly from the sleeve to the drum is, because of the relation of the electric field formed across the drum and the sleeve and the mirror image force acting between the toner and the sleeve. Thus, the foregoing indicates that the number percentage of the toner having Q/M of −5 (μC/g) or more based on the whole toner must be made greater in order to develop every dot at a high resolution.

The light portion potential Vl of the latent image corresponds to an attenuation peak potential. With regard to the weight average particle diameter of the toner, it can be measured by various methods using a Coulter counter Model TA-II or Coulter Multisizer (manufactured by Coulter Electronics, Inc.). In the present invention, it is measured using Coulter Multisizer (manufactured by Coulter Electronics, Inc.). An interface (manufactured by Nikkaki k.k.) that outputs number distribution and volume distribution and a personal computer PC9801 (manufactured by NEC.) are connected, and the particle size range is outputted as data divided into 16 ranges. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 μm by means of the above Coulter Multisizer, using an aperture of 100 μm as its aperture. From the volume distribution, the weight-based weight average particle diameter is determined.

Figure 2:
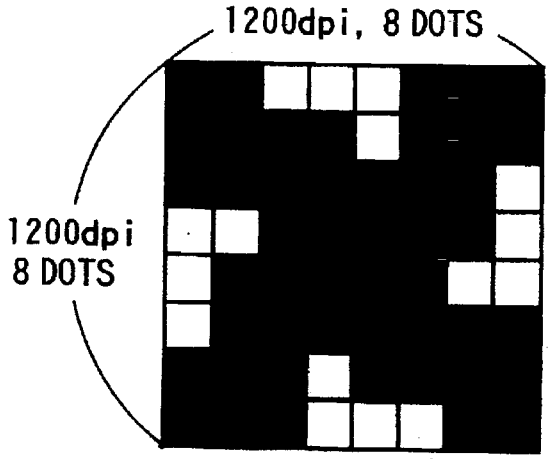
FIG. 2 illustrates a 8×8 dither matrix at a resolution of 1,200 dpi used in embodiments of the present invention.

To confirm whether or not the conditions of the expression (1) set forth in the first embodiment are satisfied in an actual machine, the laser spot diameter was changed to 83 μm, 62 μm and 41 μm in the case when the resolution is 1,200 dpi (pixel size: about 21 μm), where the relationship between toner particle diameters, Q/M, every-dot ranks and blank-dot ranks was examined. A jumping development system was used, and the drum-to-sleeve distance was set to be 300 μm. Herein, the every-dot ranks refer to the degree to which every dot is developed at a resolution of 1,200 dpi, and are indicated according to 1 to 5 ranks, "1" as being poor, and "5", good. The blank-dot ranks refer to, when 48 dots are developed using a 8×8 dither matrix as shown in FIG. 2, how the reproducibility of 16 pixels is not developed, and are indicated according to 1 to 5 ranks.

The laser spot diameter herein referred to is indicated as the width at height of $1/e^2$ with respect to a peak value in laser light emission distribution taking the form of Gaussian distribution. In the case when the cross section of a spot is not perfectly circular, its maximum diameter is defined as the spot diameter.

The results of measurement in the case when the laser spot diameter is 83 μm are shown in Table 2; the results of measurement in the case when the laser spot diameter is 62 μm, in Table 3; and the results of measurement in the case when the laser spot diameter is 41 μm, in Table 4.

With regard to the Q/M of toner, toner is collected by blowing air on the developing sleeve on which the toner has been coated, and the Q/M is measured and counted at the time the toner particle diameter is measured, by means of E-SPART ANALYZER, manufactured by Hosokawa Micron K. K.

TABLE 2

Every-dot Rank & Blank-dot Rank in the Case of Laser Spot Diameter of 83 μm (resolution: 1,200 dpi)

| Number percentage of toner having Q/M of −5 (μC/g) or more based on the whole toner % | Toner average particle diameter (μm) | Every-dot rank | Blanket-dot rank |
|---|---|---|---|
| 30.3 | 6.9 | 5 | 1 |
| | 5.9 | 5 | 2 |
| | 5.1 | 5 | 3 |
| 24.2 | 6.9 | 5 | 1 |
| | 5.9 | 5 | 3 |
| | 5.1 | 4 | 4 |
| 17.6 | 6.9 | 5 | 2 |
| | 5.9 | 3 | 4 |
| | 5.1 | 2 | 5 |
| 12.5 | 6.9 | 3 | 2 |
| | 5.9 | 1 | 4 |
| | 5.1 | 1 | 5 |

TABLE 3

Every-dot Rank & Blank-dot Rank in the Case of Laser

| Laser spot diameter (μm) | Latent image potential difference −(Vd − V1) (V) | Toner weight average particle diameter (μm) | Number percentage of toner having Q/M of −5 (μC/g) or more based on the whole toner |
|---|---|---|---|
| 83 | 63 | 6.9 | 12.5% or more |
| | | 5.9 | 17.6% or more |
| | | 6.1 | 24.2% or more |
| 62 | 112 | 6.9 | 9.9% or more |
| | | 5.9 | 14.0% or more |
| | | 5.1 | 19.3% or more |
| 41 | 224 | 6.9 | 7.5% or more |
| | | 5.9 | 10.6% or more |
| | | 5.1 | 14.6% or more |

TABLE 4

Every-dot Rank & Blank-dot Rank in the Case of Laser

| Laser spot diameter (μm) | Latent image potential difference −(Vd − V1) (V) | Toner weight average particle diameter (μm) | Number percentage of toner having Q/M of −5 (μC/g) or more based on the whole toner |
|---|---|---|---|
| 18.2 | 6.9 | 5 | 1 |
| | 5.9 | 5 | 3 |
| | 5.1 | 5 | 4 |
| 14.6 | 6.9 | 5 | 1 |
| | 5.9 | 5 | 4 |
| | 5.1 | 3 | 4 |
| 10.6 | 6.9 | 5 | 2 |
| | 5.9 | 3 | 4 |
| | 5.1 | 2 | 5 |
| 7.5 | 6.9 | 3 | 4 |
| | 5.9 | 1 | 5 |
| | 5.1 | 1 | 5 |

The results shown in Tables 2, 3 and 4 show the relationship between the number percentage of the toner having Q/M of −5 (μC/g) or more based on the whole toner and the every-dot ranks and blank-dot ranks with respect to the tone average particle diameter. Ideally, since the size of one dot is about 21 μm in the case of 1,200 dpi, it is preferable for the laser spot diameter to be in substantially the same size. Actually, however, if the laser spot diameter is reduced, the focal length becomes small, so that the scanner must be precisely fitted to the main body and the function of automatic focussing must be provided. Hence, a scanner with a laser spot diameter of about 80 μm is commonly used. However, in the case of the resolution of 1,200 dpi, even when the scanner has a laser spot diameter of 83 μm which is about four times the size of one dot and the toner has a weight average particle diameter of 5.1 μm, it has been found that every dot can be developed, as being 4 in respect of the every-dot rank (Table 2), so long as the number percentage of the toner having Q/M of −5 (μC/g) or more based on the whole toner is 24%. However, since every dot is surely developed in practical images even when the every-dot rank is 3, instances where the every-dot rank is 3 or higher are regarded as "good". If so, one may tend to consider that the number percentage of the toner having Q/M of −5 (μC/g) or more based on the whole toner may be made 50% or more or the Q/M of the toner may be made much larger whereby every dot can be better developed at a correspondingly higher resolution. If so made, on the other hand, with respect to the toner, its mirror image force acting on the sleeve becomes stronger than the flying electric field acting across the drum and the sleeve, so that the toner can not fly to the drum. Also, if the Q/M is not made larger to such an extent that the toner can not fly to the drum, a problem may arise such that solid black images have an insufficient density due to charge-up during running in an environment of low temperature and low humidity, and thus a further increase of Q/M than that inversely causes image deterioration. Accordingly, with regard to the images, it is not preferable to increase the number percentage of the toner having Q/M of −5 (μC/g) or more based on the whole toner or to make the Q/M larger.

Thus, it follows from Tables 2, 3 and 4 that the conditions necessary for developing every dot are as shown in Table 5. Table 5 shows the relationship between the laser spot diameter, the potential difference |Vd−Vl| (V) of the latent image, the average particle diameter (μm) of the toner and the number percentage of the toner having Q/M of −5 (μC/g) or more based on the whole toner that are necessary for developing every dot in the case of 212 lines and a screen angel of 45° at a resolution of 1,200 dpi.

TABLE 5

Conditions Necessary for Developing Every Dot (resolution: 1,200 dpi)

| Laser spot diameter (μm) | Latent image potential difference −(Vd − V1) (V) | Toner weight average particle diameter (μm) | Number percentage of toner having Q/M of −5 (μC/g) or more based on the whole toner |
|---|---|---|---|
| 83 | 138 | 6.9 | 9.1% or more |
| | | 5.9 | 12.9% or more |
| | | 5.1 | 17.7% or more |
| 62 | 222 | 6.9 | 7.5% or more |
| | | 5.9 | 10.6% or more |
| | | 5.1 | 14.6% or more |
| 41 | 379 | 6.9 | 6.1% or more |
| | | 5.9 | 86.6% or more |
| | | 5.1 | 11.8% or more |

Now, the constant a and the multipliers A and B in the expression (1) will be found from the results shown in Table 5. The resolution is 1,200 dpi.

First, logarithms are taken at both sides of the expression (1).

log f>log a−Blog y−Alog x

When the toner weight average particle diameter y (m) is assumed as a constant and the latent image potential difference (dark portion potential Vd−light portion potential Vl)× (V) as a variable, the value of log a−Blog y becomes a constant, and therefore the multiplier A is a slope of:

logf/logx.

Figure 3:
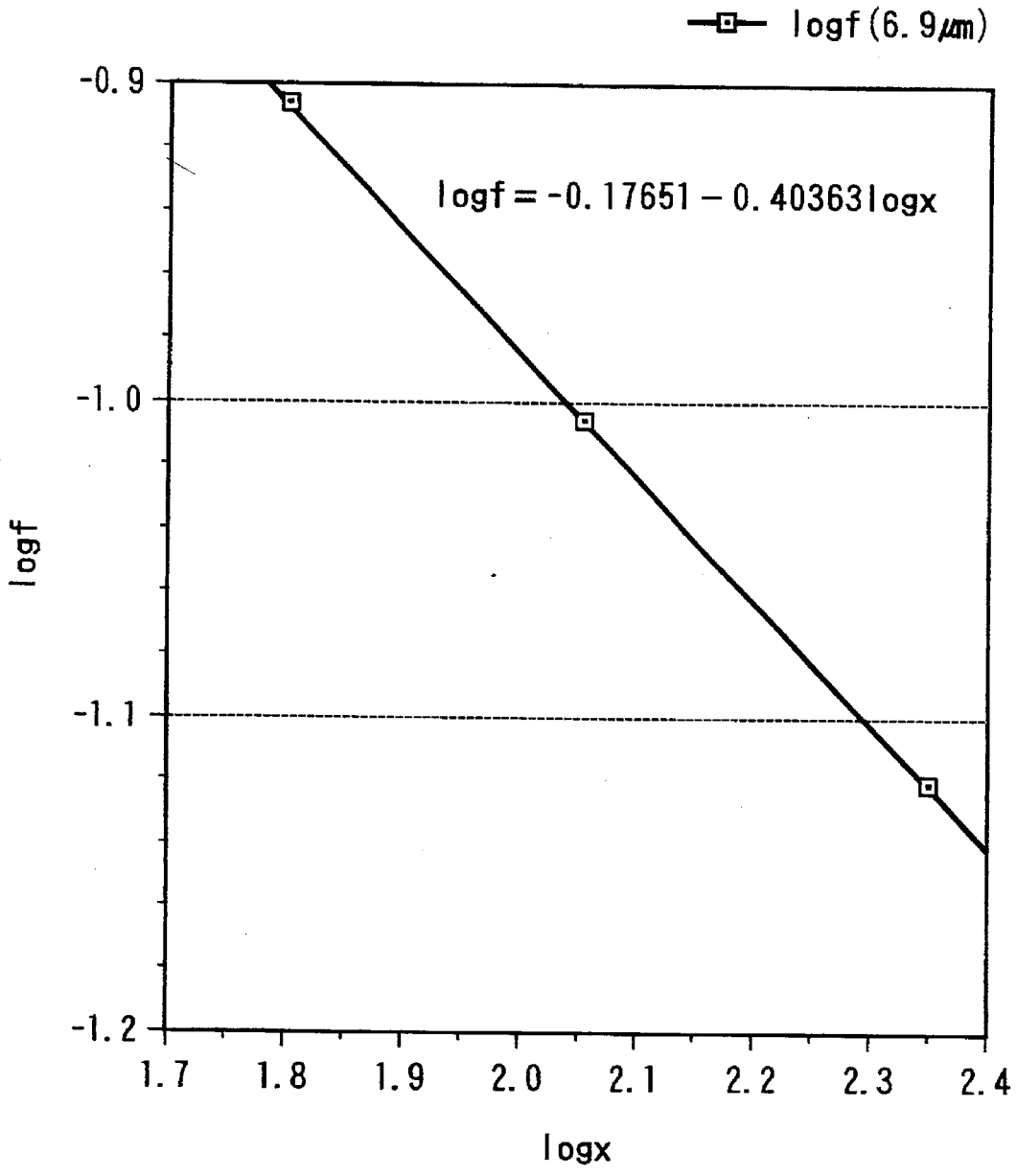
FIG. 3 is a graph to show the relationship between the potential difference of a latent image and the number percentage of a toner having Q/M of −5 (μC/g) or more based on the whole toner, according to the first embodiment of the present invention.

FIG. 3 shows the relationship between the logarithm of the potential difference x of the latent image and the logarithm of the number percentage f of the toner having Q/M of −5 (μC/g) or more based on the whole toner in the case of toner weight average particle diameter y=6.9 (μm) and latent image potential difference x=63, 112 or 224 (V) at a resolution of 1,200 dpi. Calculation of multiplier A(slope of logf/logx) by using FIG. 3 gives the multiplier A=0.4. Similar calculation in respect of other toner weight average particle diameter gives A=0.4. Now, similarly, when the latent image potential difference x (V) is assumed as a constant and the toner weight average particle diameter y (m) as a variable, the value of log a −Alog x becomes a constant, and therefore the multiplier B is a slope of:

logf/logy.

Figure 4:
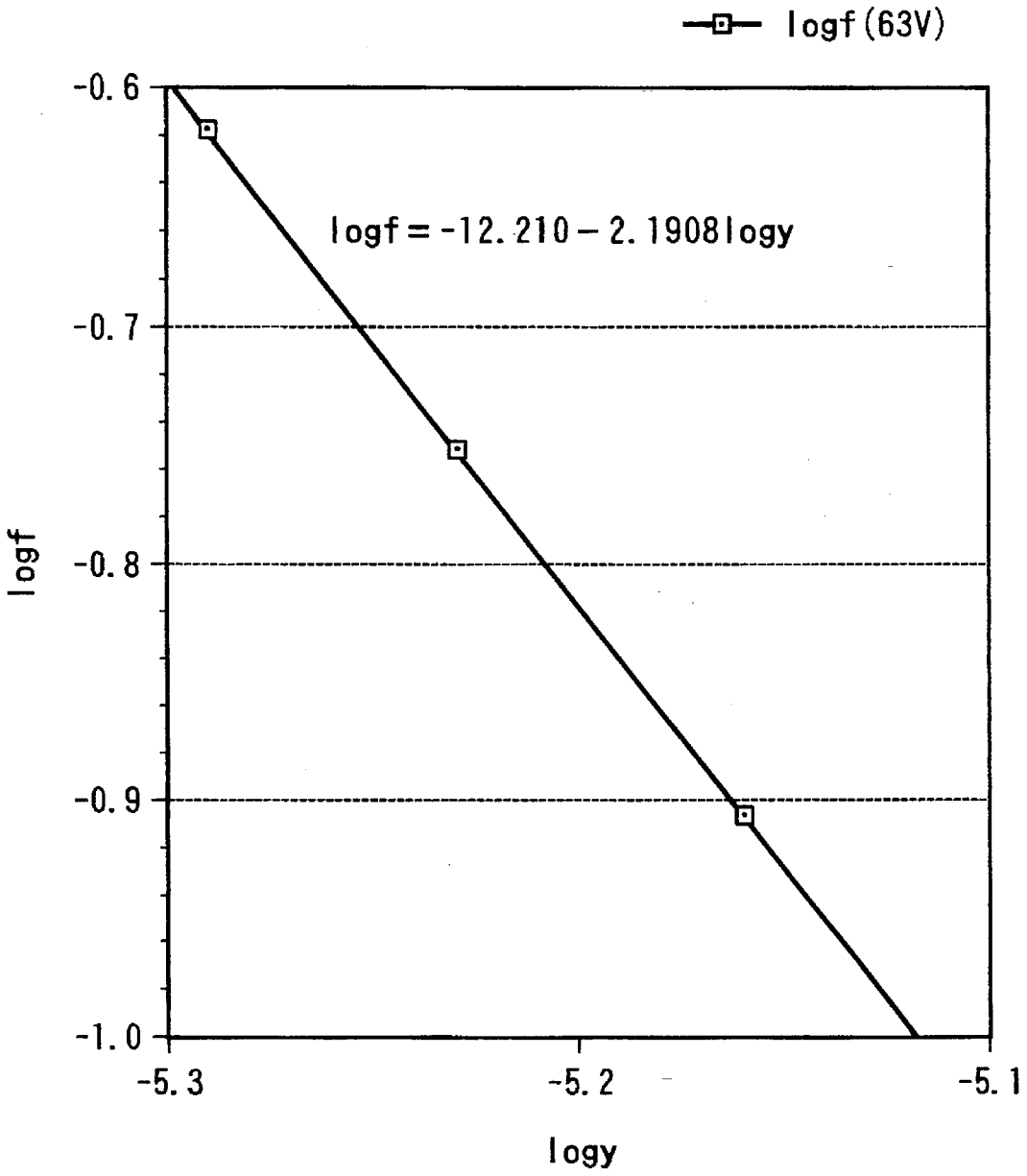
FIG. 4 is a graph to show the relationship between the weight average particle diameter of a toner and the number percentage of the toner having Q/M of −5 (μC/g) or more based on the whole toner, according to the first embodiment of the present invention.

FIG. 4 shows the relationship between the logarithm of the toner weight average particle diameter y and the logarithm of the number percentage f of the toner having Q/M of −5 (μC/g) or more based on the whole toner in the case of latent image potential difference x=63 (V) and toner weight average particle diameter=6.9, 5.9 or 5.1 (μm) at a resolution of 1,200 dpi. Calculation of multiplier B(slope of logf/logy) by using FIG. 4 gives the multiplier B=2.2. Similar calculation in respect of the latent image potential difference 112 V or 224 V also gives B=2.2. Now that the multipliers A and B have been found, the constant a is calculated using the case of latent image potential difference x=63 (V) and toner weight average particle diameter=6.9 (μm) at a resolution of 1,200 dpi, so that the constant $a=2.89\times10^{-12}$. Therefore, the expression (1) is given as the following expression (2):

$$f>\frac{2.89\times10^{-12}}{x^{0.4}y^{2.2}} \quad (2)$$

When the relation of the expression (2) is satisfied in the case of a resolution of 1,200 dpi, every dot can be developed and graphic images having a high gradation can be outputted. Also, what can be said from the expression (2) is that the every-dot reproducibility at a high resolution is more effectively achieved when the average particle diameter of the toner is made smaller, than when the latent image potential difference |Vd−Vl| (V) is made stronger, i.e., the laser spot diameter is made smaller. Then, this can be said similarly in the case when the resolution is 900 dpi, 800 dpi or 600 dpi, as shown in Tables 6, 7 and 8, respectively. Needless to say, this can also be said similarly in the case of positive toners.

TABLE 6

Conditions Necessary for Developing Every Dot (resolution: 900 dpi)

| Laser spot diameter (μm) | Latent image potential difference −(Vd − Vl) (V) | Toner weight average particle diameter (μm) | Number percentage of toner having Q/M of −5 (μC/g) or more based on the whole toner |
|---|---|---|---|
| 83 | 117 | 6.9 | 9.7% or more |
| | | 5.9 | 13.7% or more |

TABLE 6-continued

Conditions Necessary for Developing Every Dot (resolution: 900 dpi)

| Laser spot diameter (μm) | Latent image potential difference −(Vd − Vl) (V) | Toner weight average particle diameter (μm) | Number percentage of toner having Q/M of −5 (μC/g) or more based on the whole toner |
|---|---|---|---|
| | | 5.1 | 18.9% or more |
| 62 | 188 | 6.9 | 8.0% or more |
| | | 5.9 | 11.4% or more |
| | | 5.1 | 15.6% or more |
| 41 | 336 | 6.9 | 6.4% or more |
| | | 5.9 | 9.0% or more |
| | | 5.1 | 12.4% or more |

TABLE 7

Conditions Necessary for Developing Every Dot (resolution: 800 dpi)

| Laser spot diameter (μm) | Latent image potential difference −(Vd − Vl) (V) | Toner weight average particle diameter (μm) | Number percentage of toner having Q/M of −5 (μC/g) or more based on the whole toner |
|---|---|---|---|
| 83 | 138 | 6.9 | 9.1% or more |
| | | 5.9 | 12.9% or more |
| | | 5.1 | 17.7% or more |
| 62 | 222 | 6.9 | 7.5% or more |
| | | 5.9 | 10.6% or more |
| | | 5.1 | 14.6% or more |
| 41 | 379 | 6.9 | 6.1% or more |
| | | 5.9 | 8.6% or more |
| | | 5.1 | 11.8% or more |

TABLE 8

Conditions Necessary for Developing Every Dot (resolution: 600 dpi)

| Laser spot diameter (μm) | Latent image potential difference −(Vd − Vl) (V) | Toner weight average particle diameter (μm) | Number percentage of toner having Q/M of −5 (μC/g) or more based on the whole toner |
|---|---|---|---|
| 83 | 223 | 6.9 | 7.5% or more |
| | | 5.9 | 10.6% or more |
| | | 5.1 | 14.6% or more |
| 62 | 335 | 6.9 | 6.4% or more |
| | | 5.9 | 9.0% or more |
| | | 5.1 | 12.4% or more |
| 41 | 473 | 6.9 | 5.6% or more |
| | | 5.9 | 7.9% or more |
| | | 5.1 | 10.8% or more |

Second Embodiment

In the image forming apparatus previously described, in order to develop every dot when a latent image formed on the electrostatic latent image bearing member at a high resolution has no deep valleys, it is obvious that the Q/M of the toner must be increased. Then, as a result of further studies, it has been found that, even when the number percentage of a toner having Q/M of −5 (μC/g) or more based on the whole toner does not satisfy the conditions of the expression (1), the development bias AC component may be changed, whereby every dot can be developed at a high resolution to obtain an optimum image. Thus, in the present embodiment, in order to develop every dot at a high resolution to obtain an optimum image, the image forming method is characterized by satisfying the conditions of expression (3):

$$f > \frac{b}{x^A y^B} \tag{3}$$

$$\left( b = \frac{a}{\frac{E}{E_0}} \quad E_0 = \frac{|V_{dc0}| + \frac{\alpha_0}{2} + |V_{d0} - x|}{d_0} \quad E = \frac{|V_{dc}| + \frac{\alpha}{2} + |V_d - x|}{d} \right)$$

In the expression (3), letter symbol f is a number percentage (expressed in decimal form where 1 represents 100%) of the toner having Q/M of −5 (μC/g) or more based on the whole toner, x is a potential difference |Vd−Vl| (V) of the latent image, y is a weight average particle diameter (m) of the toner, a is a positive constant, where $a=2.89\times10^{-12}$, A and B are multipliers of x and y, respectively, where A=0.4 and B=2.2, E and $E_0$ are each an electric field applied across the photosensitive drum and the developing sleeve, $V_{dc}$ is a DC component of development bias and $V_{dc0}$ is −500 (V), α is an AC component of the development bias and $\alpha_0$ is 1,600 (V), Vd is a dark portion potential on the drum and $V_{d0}$ is −650 (V), and d is a distance between the drum and the sleeve and $d_0$ is 300 (μm). However, a development bias having a too strong AC component tends to cause the problem of serious occurrence of fog, and hence, in the present embodiment, with regard to images, it is not preferable to make the development bias AC component stronger than 2,000 (V).

Table 9 shows conditions of development bias AC component peak-to-peak values necessary for developing every dot at a high resolution of 1,200 dpi. As is seen from Table 9, even if the value of the expression of (2) is lower by about 2 to 3%, the development bias AC component may be made a little stronger, whereby every dot can be well developed. This can be said similarly in the case when the resolution is 900 dpi, 800 dpi or 600 dpi, as shown in Tables 10, 11 and 12, respectively.

The present inventors have also made experiments in an environment of high humidity (relative humidity: 90%) where every dot can be developed with difficulty, to confirm that every dot can be surely developed at a high resolution so long as the conditions of expression (3) are satisfied.

In the present invention, every dot can be developed even if the Q/M of toner is relatively small, so long as the development bias AC component is made stronger. Thus, the present invention has the effect of making image deterioration hardly occur.

Needless to say, this can also be said similarly in the case of positive toners.

TABLE 9

Conditions Necessary for Developing Every Dot (resolution: 1,200 dpi)

| Laser spot diameter (μm) | Latent image potential difference-(Vd − Vl) (V) | Toner weight average particle diameter (μm) | Number percentage of toner having Q/M of −5 (μC/g) or more based on the whole toner | Development bias AC component (V) |
|---|---|---|---|---|
| 83 | 63 | 6.9 | 12.5% or more | 1,600 |
| | | | 11.0 to <12.5% | 1,800 |
| | | | 9.8 to <11.0% | 2,000 |
| | | 5.9 | 17.6% or more | 1,600 |
| | | | 15.4 to <17.6% | 1,800 |
| | | | 13.7 to <15.4% | 2,000 |
| | | 5.1 | 30.6% or more | 1,600 |
| | | | 26.6 to <30.6% | 1,800 |
| | | | 23.7 to <26.6% | 2,000 |
| 62 | 112 | 6.9 | 9.9% or more | 1,600 |
| | | | 8.8 to <9.9% | 1,800 |
| | | | 7.8 to <8.8% | 2,000 |
| | | 5.9 | 14.0% or more | 1,600 |
| | | | 12.4 to <14.0% | 1,800 |
| | | | 11.1 to <12.4% | 2,000 |
| | | 5.1 | 19.3% or more | 1,600 |
| | | | 17.1 to <19.3% | 1,800 |
| | | | 15.3 to <17.1% | 2,000 |
| 41 | 224 | 6.9 | 7.5% or more | 1,600 |
| | | | 6.7 to <7.5% | 1,800 |
| | | | 6.1 to <6.7% | 2,000 |
| | | 5.9 | 10.6% or more | 1,600 |
| | | | 9.5 to <10.6% | 1,800 |
| | | | 8.6 to <9.5% | 2,000 |
| | | 5.1 | 14.6% or more | 1,600 |
| | | | 13.1 to <14.6% | 1,800 |
| | | | 11.9 to <13.1% | 2,000 |

TABLE 10

Conditions Necessary for Developing Every Dot (resolution: 900 dpi)

| Laser spot diameter (μm) | Latent image potential difference-(Vd − Vl) (V) | Toner weight average particle diameter (μm) | Number percentage of toner having Q/M of −5 (μC/g) or more based on the whole toner | Development bias AC component (V) |
|---|---|---|---|---|
| 83 | 117 | 6.9 | 9.7% or more | 1,600 |
| | | | 8.6 to <9.7% | 1,800 |
| | | | 7.7 to <8.6% | 2,000 |
| | | 5.9 | 13.7% or more | 1,600 |
| | | | 12.1 to <13.7% | 1,800 |
| | | | 10.9 to <12.1% | 2,000 |
| | | 5.1 | 18.9% or more | 1,600 |
| | | | 16.7 to <18.9% | 1,800 |
| | | | 15.0 to <16.7% | 2,000 |
| 62 | 188 | 6.9 | 8.0% or more | 1,600 |
| | | | 7.1 to <8.0% | 1,800 |
| | | | 6.5 to <7.1% | 2,000 |
| | | 5.9 | 11.4% or more | 1,600 |
| | | | 10.2 to <11.4% | 1,800 |
| | | | 9.2 to <10.2% | 2,000 |
| | | 5.1 | 15.6% or more | 1,600 |
| | | | 13.9 to <15.6% | 1,800 |
| | | | 12.6 to <13.9% | 2,000 |
| 41 | 336 | 6.9 | 6.4% or more | 1,600 |
| | | | 5.8 to <6.4% | 1,800 |
| | | | 5.3 to <5.8% | 2,000 |
| | | 5.9 | 9.0% or more | 1,600 |
| | | | 8.2 to <9.0% | 1,800 |
| | | | 7.5 to <8.2% | 2,000 |
| | | 5.1 | 12.4% or more | 1,600 |
| | | | 11.3 to <12.4% | 1,800 |
| | | | 10.3 to <11.3% | 2,000 |

TABLE 11

| Conditions Necessary for Developing Every Dot (resolution: 800 dpi) | | | | |
|---|---|---|---|---|
| Laser spot diameter (μm) | Latent image potential difference-(Vd − V1) (V) | Toner weight average particle diameter (μm) | Number percentage of toner having Q/M of −5 (μC/g) or more based on the whole toner | Development bias AC component (V) |
| 83 | 138 | 6.9 | 9.1% or more | 1,600 |
| | | | 8.1 to <9.1% | 1,800 |
| | | | 7.3 to <8.1% | 2,000 |
| | | 5.9 | 12.9% or more | 1,600 |
| | | | 11.4 to <12.9% | 1,800 |
| | | | 10.3 to <11.4% | 2,000 |
| | | 5.1 | 17.7% or more | 1,600 |
| | | | 15.7 to <17.7% | 1,800 |
| | | | 14.1 to <15.7% | 2,000 |
| 62 | 222 | 6.9 | 7.5% or more | 1,600 |
| | | | 6.7 to <7.5% | 1,800 |
| | | | 6.1 to <6.7% | 2,000 |
| | | 5.9 | 10.6% or more | 1,600 |
| | | | 9.5 to <10.6% | 1,800 |
| | | | 8.6 to <9.5% | 2,000 |
| | | 5.1 | 14.6% or more | 1,600 |
| | | | 13.1 to <14.6% | 1,800 |
| | | | 11.9 to <13.1% | 2,000 |
| 41 | 379 | 6.9 | 6.1% or more | 1,600 |
| | | | 5.6 to <6.1% | 1,800 |
| | | | 5.1 to <5.6% | 2,000 |
| | | 5.9 | 8.6% or more | 1,600 |
| | | | 7.8 to <8.6% | 1,800 |
| | | | 7.2 to <7.8% | 2,000 |
| | | 5.1 | 11.8% or more | 1,600 |
| | | | 10.8 to <11.8% | 1,800 |
| | | | 9.9 to <10.8% | 2,000 |

TABLE 12

| Conditions Necessary for Developing Every Dot (resolution: 600 dpi) | | | | |
|---|---|---|---|---|
| Laser spot diameter (μm) | Latent image potential difference-(Vd − V1) (V) | Toner weight average particle diameter (μm) | Number percentage of toner having Q/M of −5 (μC/g) or more based on the whole toner | Development bias AC component (V) |
| 83 | 223 | 6.9 | 7.5% or more | 1,600 |
| | | | 6.7 to <7.5% | 1,800 |
| | | | 6.1 to <6.7% | 2,000 |
| | | 5.9 | 10.6% or more | 1,600 |
| | | | 9.5 to <10.6% | 1,800 |
| | | | 8.6 to <9.5% | 2,000 |
| | | 5.1 | 14.6% or more | 1,600 |
| | | | 13.1 to <14.6% | 1,800 |
| | | | 11.9 to <13.1% | 2,000 |
| 62 | 335 | 6.9 | 6.4% or more | 1,600 |
| | | | 5.8 to <6.4% | 1,800 |
| | | | 5.3 to <5.8% | 2,000 |
| | | 5.9 | 9.0% or more | 1,600 |
| | | | 8.2 to <9.0% | 1,800 |
| | | | 7.5 to <8.2% | 2,000 |
| | | 5.1 | 12.4% or more | 1,600 |
| | | | 11.3 to <12.4% | 1,800 |
| | | | 10.3 to <11.3% | 2,000 |
| 41 | 473 | 6.9 | 5.6% or more | 1,600 |
| | | | 5.1 to <5.6% | 1,800 |
| | | | 4.8 to <5.1% | 2,000 |
| | | 5.9 | 7.9% or more | 1,600 |
| | | | 7.3 to <7.9% | 1,800 |
| | | | 6.7 to <7.3% | 2,000 |
| | | 5.1 | 10.8% or more | 1,600 |
| | | | 9.9 to <10.8% | 1,800 |
| | | | 9.2 to <9.9% | 2,000 |

What is claimed is:

1. An image forming method comprising the steps of:

forming an electrostatic latent image on an electrostatic latent image bearing member;

modulating light intensity in accordance with image information to form the electrostatic latent image on said electrostatic latent image bearing member;

followed by development of said electrostatic latent image, wherein;

at the time of formation of the electrostatic latent image formed of the smallest isolated dots on the electrostatic latent image bearing member, the charge density distribution, weight average particle diameter of a toner, and Q/M distribution of the toner satisfy the relationship of:

$$f > \frac{a}{x^A y^B}$$

wherein f is a number percentage (expressed in decimal form where 1 represents 100%) of a toner having Q/M of |5| (μC/g) or more based on the whole toner, where Q/M is a charge quantity Q per unit weight M; x is a potential difference |Vd−Vl| (V) of the latent image formed of the smallest isolated dots, where Vd is a dark portion potential of the latent image and Vl a light portion potential, y is a weight average particle diameter (m) of the toner; a is a positive constant, where $a=2.89\times10^{-12}$; and A and B are exponents of x and y, respectively, where A=0.4 and B=2.2.

2. The image forming method according to claim 1, wherein said electrostatic latent image is formed at a resolution of 800 dpi or higher.

3. The image forming method according to claim 1, comprising a further step of carrying a toner layer on a toner carrying member to a developing zone, wherein the toner layer has a thickness smaller than the gap between the electrostatic latent image bearing member and the toner carrying member.

4. The image forming method according to claim 1, wherein said toner is an insulating magnetic toner.

5. An image forming method comprising the steps of:

forming an electrostatic latent image on an electrostatic latent image bearing member;

modulating light intensity in accordance with image information to form the electrostatic latent image on said electrostatic image bearing member;

followed by development of the electrostatic latent image while changing a development bias AC component, wherein;

at the time of formation of an electrostatic latent image formed of the smallest isolated dots on the electrostatic latent image bearing member, the charge density distribution, weight average particle diameter of the toner, Q/M distribution of the toner, and development bias AC component satisfy the relationship of:

$$f > \frac{b}{x^A y^B}$$

$$\left( b = \frac{a}{\frac{E}{E_0}},\ E_0 = \frac{|V_{dc0}| + \frac{\alpha_0}{2} + |V_{d0} - x|}{d_0} \right),$$

-continued $$E=\frac{|V_{dc}|+\frac{\alpha}{2}+|V_d-x|}{d}\Bigg)$$

wherein f is a number percentage (expressed in decimal form where 1 represents 100%) of a toner having Q/M of |5| (μC/g) or more based on the whole toner, where Q/M is a charge quantity Q per unit weight M; x is a potential difference |Vd−Vl| (V) of the latent image formed of the smallest isolated dots, where Vd is a dark portion potential of the latent image and Vl a light portion potential; y is a weight average particle diameter (m) of the toner; a is a positive constant, where $a=2.89\times10^{-12}$; A and B are exponets of x and y, respectively, where A=0.4 and B=2.2; E and $E_0$ are each an electric field applied across the electrostatic latent image bearing member and a toner carrying member; $V_{dc}$ is a development bias DC component and $V_{dc0}$ is |500| (V); α is the development bias AC component and $\alpha_0$ is 1,600 (V); Vd is a dark portion potential on the electrostatic latent image bearing member and $V_{d0}$ is |650| (V); and d is a distance between the electrostatic latent image bearing member and the toner carrying member and $d_0$ is 300 (μm).

6. The image forming method according to claim 5, wherein said electrostatic latent image is formed at a resolution of 800 dpi or higher.

7. The image forming method according to claim 5, comprising a further step of carrying a toner layer on the toner carrying member to a developing zone, wherein the toner layer has a thickness smaller than the gap between the electrostatic latent image bearing member and the toner carrying member.

8. The image forming method according to claim 5, wherein said toner is an insulating magnetic toner.

* * * * *

UNITED STATES PATENT AND TRADEMARK OFFICE

CERTIFICATE OF CORRECTION

PATENT NO. : 5,669,036

DATED : Sept. 16, 1997

INVENTOR(S) : HOTTA ET AL.

It is certified that error appears in the above-identified patent and that said Letters Patent is hereby corrected as shown below:

Column 3

Line 15, "lagent" should read --latent--.

Column 6

Line 54, "less scatter" should read --scatter less-.

UNITED STATES PATENT AND TRADEMARK OFFICE

CERTIFICATE OF CORRECTION

PATENT NO. : 5,669,036

DATED : Sept. 16, 1997

INVENTOR(S) : HOTTA ET AL.

It is certified that error appears in the above-identified patent and that said Letters Patent is hereby corrected as shown below:

Column 9

Table 3, TABLE 3 should read as follows:

--

Table 3

Every-dot Rank & Blank-dot Rank in the Case of Laser Spot Diameter of 62 μm (resolution: 1,200 dpi)

| Number percentage of toner having Q/M of -5 (μC/g) or more based on the whole toner (%) | Toner average particle diameter (μm) | Every-dot rank | Blank-dot rank |
|---|---|---|---|
| 24.1 | 6.9 | 5 | 1 |
| | 5.9 | 5 | 3 |
| | 5.1 | 5 | 3 |
| 19.3 | 6.9 | 5 | 1 |
| | 5.9 | 5 | 3 |
| | 5.1 | 4 | 4 |
| 14.0 | 6.9 | 5 | 2 |
| | 5.9 | 3 | 4 |
| | 5.1 | 2 | 5 |
| 9.9 | 6.9 | 3 | 3 |
| | 5.9 | 2 | 4 |
| | 5.1 | 1 | 5 |

--.

UNITED STATES PATENT AND TRADEMARK OFFICE

CERTIFICATE OF CORRECTION

PATENT NO. : 5,669,036

DATED : Sept. 16, 1997

INVENTOR(S) : HOTTA ET AL.

It is certified that error appears in the above-identified patent and that said Letters Patent is hereby corrected as shown below:

Column 9 (cont.)

Table 4, TABLE 4 should read as follows:

--

Table 4

Every-dot Rank & Blank-dot Rank in the Case of Laser Spot Diameter of 41 μm (resolution: 1,200 dpi)

| Number percentage of toner having Q/M of -5 (μC/g) or more based on the whole toner (%) | Toner average particle diameter (μm) | Every-dot rank | Blank-dot rank |
|---|---|---|---|
| 18.2 | 6.9 | 5 | 1 |
| | 5.9 | 5 | 3 |
| | 5.1 | 5 | 4 |
| 14.6 | 6.9 | 5 | 1 |
| | 5.9 | 5 | 4 |
| | 5.1 | 3 | 4 |
| 10.6 | 6.9 | 5 | 2 |
| | 5.9 | 3 | 4 |
| | 5.1 | 2 | 5 |
| 7.5 | 6.9 | 3 | 4 |
| | 5.9 | 1 | 5 |
| | 5.1 | 1 | 5 |

--.

UNITED STATES PATENT AND TRADEMARK OFFICE

CERTIFICATE OF CORRECTION

PATENT NO. : 5,669,036

DATED : Sept. 16, 1997

INVENTOR(S) : HOTTA ET AL.

It is certified that error appears in the above-identified patent and that said Letters Patent is hereby corrected as shown below:

Column 10

TABLE 5

2nd Column, "138 222 379" should read -- 63 112 224--; and

4th Column, " 9.1% or more
12.9% or more
17.7% or more
7.5% or more
10.6% or more
14.6% or more
6.1% or more
86.6% or more
11.8% or more" should read --12.5% or more
17.6% or more
24.2% or more
9.9% or more
14.0% or more
19.3% or more
7.5% or more
10.6% or more
14.6% or more--.

Column 16

Line 27, "Vl" should read --Vl is--.

Column 17

Line 11, "Vl" should read --Vl is--; and

UNITED STATES PATENT AND TRADEMARK OFFICE

CERTIFICATE OF CORRECTION

PATENT NO. : 5,669,036

DATED : Sept. 16, 1997

INVENTOR(S) : HOTTA ET AL.

It is certified that error appears in the above-identified patent and that said Letters Patent is hereby corrected as shown below:

Column 17

Line 14, "exponets" should read --exponents--.

Signed and Sealed this

Thirty-first Day of March, 1998

Bruce Lehman

BRUCE LEHMAN

*Commissioner of Patents and Trademarks*

*Attest:*

*Attesting Officer*